US005365610A

United States Patent [19]

Lubahn et al.

[11] Patent Number: 5,365,610

[45] Date of Patent: Nov. 22, 1994

[54] SPORTS PANTS WITH POCKETED TACKED PADS

[75] Inventors: Kathleen A. Lubahn; Rick A. Lehman, both of Jackson, Mich.

[73] Assignees: KBL Apparel Manufacturing Inc.; Austin Sports-gear, Inc., both of Jackson, Mich.

[21] Appl. No.: 100,768

[22] Filed: Aug. 2, 1993

[51] Int. Cl.[5] ..... A41D 13/00

[52] U.S. Cl. ..... 2/23; 2/227; 2/267

[58] Field of Search ..... 2/2, 69, 227, 79, 267, 2/268, 16, 20, 22, 23, 24, 247, 250; 602/60, 61, 62, 63, 64; 450/57, 98

[56] References Cited

U.S. PATENT DOCUMENTS

| | | | |
|---|---|---|---|
| 1,483,299 | 2/1924 | Goldsmith . | |
| 1,598,133 | 8/1926 | Hanson . | |
| 4,324,012 | 4/1982 | Cannaday | 2/2 |
| 4,613,991 | 9/1986 | Grover . | |
| 4,894,867 | 1/1990 | Ceravolo et al. | 2/227 |
| 4,987,613 | 1/1991 | Loverdi et al. . | |
| 5,014,354 | 5/1991 | Dumont | 2/2 |
| 5,134,726 | 8/1992 | Ross . | |
| 5,161,257 | 11/1992 | Arensdorf et al. . | |

*Primary Examiner*—Clifford D. Crowder
*Assistant Examiner*—Gloria Hale
*Attorney, Agent, or Firm*—Beaman & Beaman

[57] ABSTRACT

A garment for wearing while playing sports having padded portions to absorb impact to protect specific body parts, the impact protection being provided by a shock absorbing pad located within a pocket defined on the garment. The pocket receives the protective pad, usually formed of foam, and while the configuration of the pocket substantially conforms to the configuration of the pad, the pad is only affixed to the garment at a location remote from the pad edges whereby the pad edges are free and may adapt themselves to the configuration of the garment and wadding or extensive pad stressing is prevented, and the pad will automatically accommodate itself to the garment and body configuration.

14 Claims, 2 Drawing Sheets

SPORTS PANTS WITH POCKETED TACKED PADS

BACKGROUND OF THE INVENTION

1. Field of the Invention The invention pertains to sports garments having shock absorbing pads wherein the pad will automatically conform to the garment and body configuration and effectively protect the desired body area.

2. Description of the Related Art

Sports garments commonly worn by athletes while playing games, such as pants, shirts, and the like, often incorporate protective shock absorbing pads into the garment. The pads may be built into the garment directly, or the garment may be provided with a plurality of pockets in which the pads are located. The pads may be formed of fabric, rubber, or similar material, and closed cell foam is now commonly used as a protective pad in many sports garments. Typical sports garments of the protective type are shown in U.S. Pat. Nos. 1,483,299; 1,598,133; 4,894,867; 4,987,613 and 5,134,726.

Commonly, the protective pad may be sewn at its periphery to the garment, or to a pocket sewn to the garment. Such peripheral attachment of the pad to the garment will place high stresses upon the pad during certain activities such as excessive stretching, sliding into a baseball base, and the like. If the protective pad is merely inserted into the pocket having a configuration similar to that of the pocket without the pad being sewn or otherwise attached to the pocket or the garment, itself, the pad often has a tendency to wad and fold up within the pocket as the pocket and pad are subjected to the movement and stresses imposed on the garment during sport activities. Of course, such wadding of the pad reduces its efficiency, and produces an unsightly bulge as well as causing discomfort to the wearer.

OBJECTS OF THE INVENTION

It is an object of the invention to provide a sports garment of the protective pad type wherein a shock absorbing pad is located within a garment pocket and is so attached to the garment as to maintain the pad within the pocket, yet permit the pad to automatically accommodate itself to the body and garment configuration without wadding or folding, even under extreme stress and garment agitation.

Another object of the invention is to provide a sports garment having a protective pad located within a pocket sewn to the garment wherein the peripheral edges of the pad are free, and the pad is only affixed to the garment at a central region remote from the pad edges.

A further object of the invention is to provide a sports garment having a protective pad located with a pocket wherein a zigzag stitch used at the central region of the pad attaches the pad to the pocket only remote from the pad edges, and the fact that the pad is not attached to the garment directly reduces stresses imposed upon the pad.

SUMMARY OF THE INVENTION

A sports garment utilizing the inventive concepts includes a flexible envelope, in the configuration of pants, a shirt, arm or forearm guards, or the like. A pocket is sewn to the inside surface of the garment for receiving a protective pad, preferably of a closed cell foam. The pad will have a configuration substantially identical to that of the pocket, and the pad is retained within the pocket by fastening means, such as a zigzag stitch, located at the central region of the pad attaching the pad to the pocket panel, only. As the edges of the pad are free, and unattached, the configuration of the pad will be maintained by the pocket and undue stresses are not placed upon the pad. The pad will not wad or be excessively stretched.

If it is desired to wash the garment without the pad, the stitching may be cut, permitting the pad to be withdrawn from the pocket, and permitting washing.

While zigzag stitching is preferred in holding the pad to the garment, and particularly to the pocket panel, other attachment means such as hook and loop fasteners, or snaps, could be employed.

BRIEF DESCRIPTION OF THE DRAWINGS

The aforementioned objects and advantages of the inventive concepts will be appreciated from the following description and accompanying drawing wherein.

DESCRIPTION OF THE PREFERRED EMBODIMENTS

Figure 1:
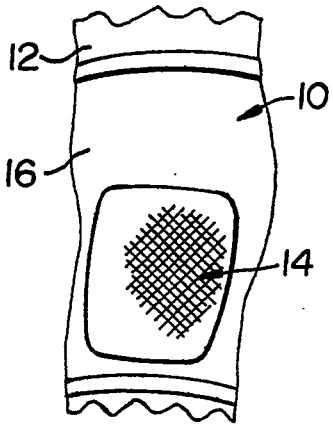
FIG. 1 is a reduced scale elevational view of a padded sports garment, as worn, having a hip protective pad.
Figure 2:
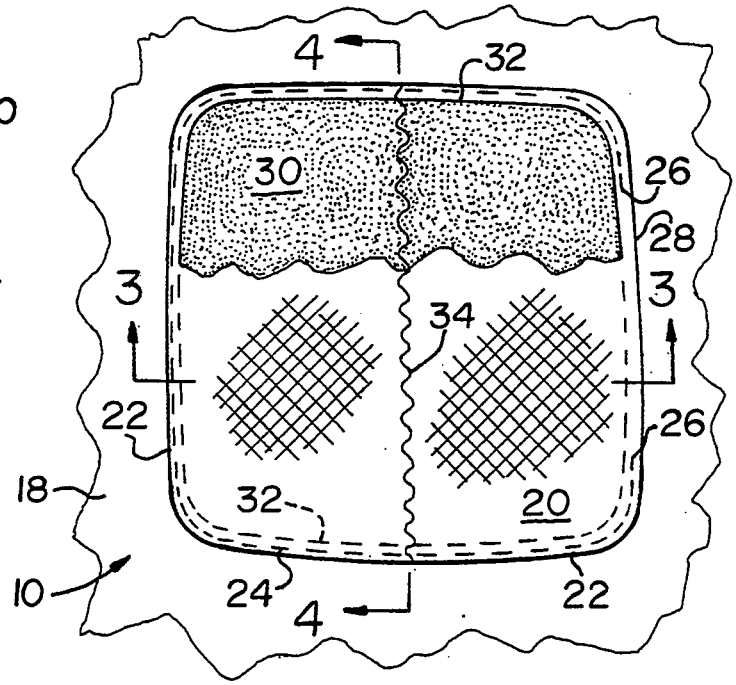
FIG. 2 is an enlarged detail elevational view of the inside surface of the garment of FIG. 1 illustrating the pocket and pad structure, a portion of the pocket panel being broken away for purpose of illustration.
Figure 3:
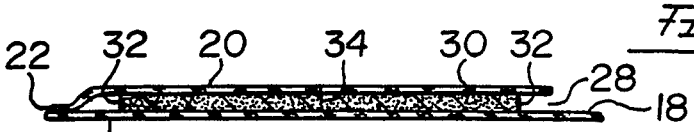
FIG. 3 is an elevational sectional view taken along Section 3—3 of FIG. 2.
Figure 4:
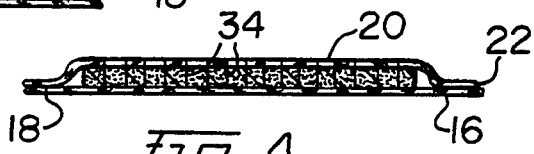
FIG. 4 is an elevational sectional view taken along Section 4—4 of FIG. 2.

A sports garment in the form of pants is shown in FIG. 1 as generally represented at 10. The pants 10 are worn by the athlete 12, usually as an undergarment with a baseball uniform or the like whereby the hip protector portion 14 of the pants 10 will protect the wearer during sliding, and the like. The pants garment 10 is formed of a fabric, usually an elastic fabric, and includes an outer surface 16 and an inner surface 18. A pocket panel 20, FIG. 2, is sewn unto the garment upon the garment inner surface 18, and the pocket panel is defined by edges 22. Sewn stitch 24 affixes the pocket panel 20 to the pants 10. With reference to FIG. 2, the stitching 24 is terminated at locations 26 to define a lateral opening 28 into the pocket formed by the pants inner surface 18 and the pocket panel 20, and the opening 28 permits the shock absorbing pad 30 to be located within the pocket. Preferably, the pad 30 is formed of a closed cell foam, and is flexible, but capable of resiliently resisting crushing as to protect the wearer 12 during falls, sliding, and the like. The circumferential edges of the pad 30 are represented at 32, and as will be appreciated from FIG. 2 the pad edges 32 are of a configuration substantially corresponding to the form of the pocket panel 20.

Usually, with padded garments employing pockets, the impact absorbing pads are located within a pocket and sewn or otherwise affixed therein. Such affixing usually takes place adjacent the edges of the pad, but in many installations the pad is not sewn to the garment at all, but is merely "loosely" located within the pocket.

Pads loosely located within the pocket tend to wad up or ball up during strenuous activities, such as sliding, and when the pad is sewn to the associated garment adjacent the pad periphery the pad may be subjected to excessive stretching and tearing during use, and such a pad is not readily removable from the garment pocket in the event of the washing of the garment when the washing of the pad is not desired.

The invention overcomes the aforementioned deficiencies by utilizing a sewn stitch 34 extending substantially the height of the pad 30. The stitch 34 is centrally located upon the pad 30 and pocket panel 20, and only extends through the pocket panel 20 and pad, and does not extend through the pants 10 and pants surfaces 16 and 18. Accordingly, it will be appreciated that the pad 30 is only affixed to the garment 10 through the pocket panel 20, and the stitching 34 is centrally located with respect to the circumferential lateral edges of the pad.

By utilizing the described stitch 34 to attach the pad to the pocket panel 20 the edges of the pad are "free" within the pocket, and this freedom of the circumference of the pad permits the pad to readily adapt itself to the most effective and comfortable configuration of the garment as worn. However, the presence of the stitching 34 prevents the pad 30 from moving around within the pocket defined by the panel 20, and prevents balling up or wadding up of the pad within its pocket. Accordingly, the stitch 34 will assure proper configuration and location of the pad 30 within the garment pocket, and if it is desired to remove the pad 30 from the garment prior to washing, or for other reasons, access to the interior of the pocket panel 20 through the opening 28 is possible, and the stitching 34 may be cut to remove the pad from its attachment with the pocket panel.

Preferably, the stitch 34 is of a zigzag type so as to accommodate stretching of the garment 10 and pocket panel 20 in a vertical direction. Also, it is to be appreciated that the inventive concepts may be utilized by using other means for fastening the central region of the pad 30 to the pocket panel 20 than stitching. For instance, loop and hook fasteners may be employed, or snap fasteners of a simple nature are available.

Figure 5:
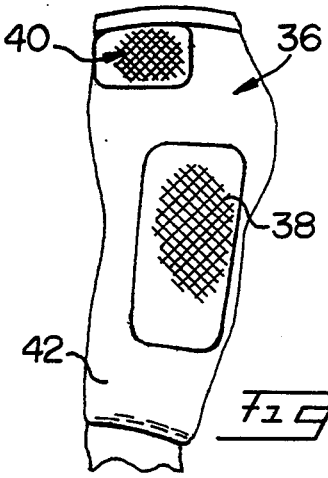
FIG. 5 is a reduced scale elevational view of a sports garment pants utilizing both hip and waist protective pads.

In FIG. 5, a variation of pants sport garment 36 is illustrated having a hip pad region 38 and a waist pad 40. As with the garment shown in FIG. 1, it will be appreciated that the pads 38 and 40 are duplicated on opposite sides of the garment, and as the pocket panels receiving the pads are located on the inner surface of the garment, the representations of the pad protectors in FIGS. 1 and 5 are bulges, but the stitching for the pocket panels and the like is usually only observable from the inside of the garment.

Figure 6:
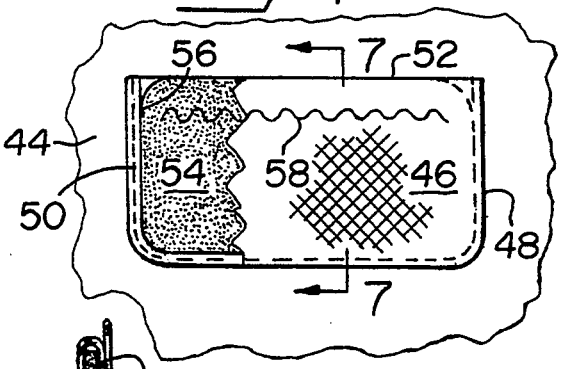
FIG. 6 is an enlarged detail inside elevational view of the waist pad pocket panel, a portion of which is broken away for purpose of illustration.

The pant garment 36 includes an outer surface 42 and an inner surface 44, and the waist pad 40 includes the pocket panel 46 having peripheral edges 48, FIG. 6. The lateral and lowermost edges 48 of the pocket panel 46 are attached to the garment inner surface 44 by sewn stitching 50, and at its upper region, the pocket panel 46 includes a flap or tongue 52 which extends over the pad and downwardly as will be appreciated from FIG. 7. The shock absorbing foam pad 54 is located within the pocket defined by the pocket panel 46 and the pant inner surface 44, and the pad 54 includes circumferential edges 56.

Figure 7:
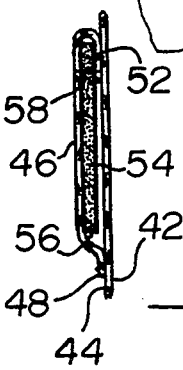
FIG. 7 is an elevational sectional view as taken along Section 7—7 of FIG. 6.

The pad 54 is sewn to both the innermost portions of the pocket panel 46 and also to the flap 52 as shown in FIG. 7 by a zigzag stitch 58. As the stitch 58 is located remotely from the lower and upper edges of the pad 54 the inventive concepts with respect to the location of the pad within the pocket as described above also applies to this version of protective pad. If it is desired to remove the pad 54 from its pocket the stitching 58 may be easily cut.

Figure 8:
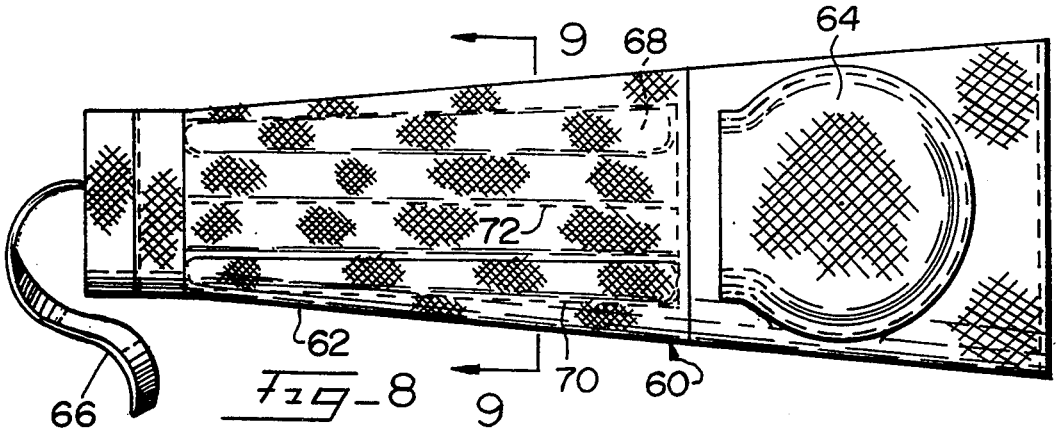
FIG. 8 is an elevational view of an arm protective garment utilizing the inventive concepts.
Figure 9:
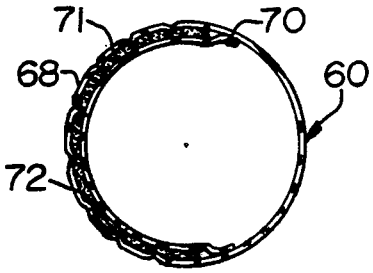
FIG. 9 is an elevational sectional view taken along Section 9—9 of FIG. 8.

FIGS. 8 and 9 disclose another type of protective sports garment with which the invention may be used. The garment envelope 60 is formed of an elasticized fabric, and is of such a configuration as to slip over the forearm of an athlete, such as a football player. Portion 62 encompasses the wearer's forearm, while portion 64 constitutes an elbow guard extending over the wearer's elbow. A hand strap 66 using a hook and loop fastener may be used to pass around the hand and keep the envelope 60 from axially moving up on the arm during use.

A pocket panel 68 is sewn to the inner surface of the forearm portion 62 by stitch 70, and the pad 71 is centrally sewn to the pocket panel 68 by stitch 72. In this manner, the pad 71 will readily accommodate itself to the configuration of the envelope forearm portion 62, the pad will not wad up or fold within the pocket, and the basic advantages and inventive concepts of the previously described embodiments exist.

Figure 10:
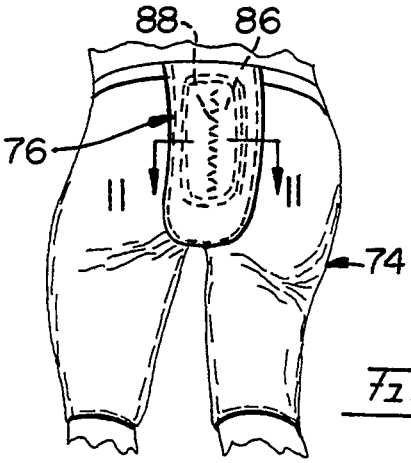
FIG. 10 is a rear elevational view of sport garment pants utilizing a tailbone protective pad affixed to the garment in accord with the inventive concepts.
Figure 11:
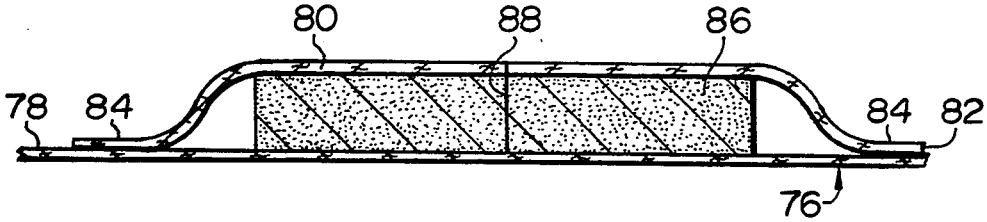
FIG. 11 is a plan sectional view taken along Section 11—11 of FIG. 10.

In FIGS. 10 and 11, the rear view of a pants garment utilizing the inventive concepts in a tailbone protector are shown. The pants garment 74 includes a central rear panel 76 which is sewn to the hip defining panels of the garment. The hip defining portions of the garment include an inner surface 78, and stitching, which defines a pocket panel 80 having ends 82, and the pocket panel 80 is sewn to the inner surface 78 by stitching 84. A shock absorbing pad 86 is located within the pocket defined by the panel 80 and the garment inner surface 78, and central zigzag stitching 88, which defines a vertically extending stitch, attaches the central region of the pad 86 to the central region of the pocket panel 80 while leaving the edges of the pad 86 free so as to accommodate itself to the configuration of the garment when worn.

This type of tailbone protective pad will assure the proper location of the pad 86 over the tailbone, and permit a comfortable pad fit which provides efficient protection at all times.

It is appreciated that various modifications to the inventive concepts may be apparent to those skilled in the art without departing from the spirit and scope of the invention.

We claim:

1. In a padded sports garment for protecting the wearer wherein the garment includes a primary flexible envelope having inner and outer surfaces, a pocket panel mounted upon one of the surfaces defining a pocket and a thin shock absorbing flexible pad having a circumference including spaced opposed edges and a central region intermediate the circumference located within the pocket, the improvement comprising, a fastener directly attached to the pad central region and fastening only the pad central region with respect to the envelope and pocket whereby the pad circumference is free at the spaced opposed edges and only confined against movement by the pocket and the pad may conform itself within the pocket to the contour of the garment envelope and pocket.

2. In a padded sports garment as in claim 1, said fastener comprising a seam tack.

3. In a padded sports garment as in claim 2, said seam tack comprising a sewn seam located between the pad opposed edges.

4. In a padded sports garment as in claim 1, said garment comprising pants.

5. In a padded sports garment as in claim 1, said garment comprising a forearm guard.

6. In a padded sports garment for protecting the wearer wherein the garment includes a primary flexible envelope having inner and outer surfaces, a pocket panel mounted upon one of the surfaces defining a pocket and a shock absorbing flexible pad having a circumference including spaced opposed edges and a central region intermediate the circumference located within the pocket, the improvement comprising, a fastener fastening only the pad central region with respect to the envelope and pocket whereby the pad circumference is free and the pad may conform itself to the contour of the garment envelope and pocket, said fastener comprising a seam tack, said seam tack comprising a sewn seam located between the pad opposed edges, said sewn seam fastening the pad central region to the pocket panel only, said pocket panel being attached to the envelope inner surface.

7. In a padded sports garment as in claim 6, said sewn seam comprising a longitudinal zigzag stitch to permit longitudinal seam expansion.

8. In combination, a garment comprising a flexible envelope having inner and outer surfaces, a pocket panel mounted upon one of the surfaces defining a pocket and a thin shock absorbing flexible pad having a circumference including spaced opposed edges and a central region intermediate the circumference located within the pocket, a fastener directly attached to said pad central region and fastening only the pad central region with respect to the envelope and pocket whereby the pad circumference is free at said spaced opposed edges and only confined against movement by the pocket and the pad may conform itself within the pocket to the contour of the garment envelope and pocket.

9. In a combination as in claim 8, said fastener comprising a seam tack.

10. In a combination as in claim 9, said seam tack comprising a sewn seam located between the pad opposed edges.

11. In a combination as in claim 8, said garment comprising pants.

12. In a combination as in claim 8, said garment comprising a forearm guard.

13. In combination, a garment comprising a flexible envelope having inner and outer surfaces, a pocket panel mounted upon one of the surfaces defining a pocket and a shock absorbing flexible pad having a circumference including spaced opposed edges and a central region intermediate the circumference located within the pocket, a fastener fastening only the pad central region with respect to the envelope and pocket whereby the pad circumference is free and the pad may conform itself to the contour of the garment envelope and pocket, said fastener comprising a seam tack, said seam tack comprising a sewn seam located between the pad opposed edges, said sewn seam fastening the pad central region to the pocket panel only, said pocket panel being attached to the envelope inner surface.

14. In a combination as in claim 13, said sewn seam comprising a longitudinal zigzag stitch to permit longitudinal seam expansion.

* * * * *